United States Patent [19]

Bellis et al.

[11] Patent Number: 5,007,806

[45] Date of Patent: Apr. 16, 1991

[54] FUEL PUMP

[75] Inventors: Peter D. Bellis; Frederick Nesselrode, both of Carson City, Nev.

[73] Assignee: Mallory, Inc., Carson City, Nev.

[21] Appl. No.: 330,496

[22] Filed: Mar. 30, 1989

[51] Int. Cl.[5] ..... F04B 17/00; F04B 35/00

[52] U.S. Cl. ..... 417/360; 417/366; 123/509

[58] Field of Search ..... 123/198 C, 509, 195 A; 418/171, 182; 417/366, 360, 361, 364, 359

[56] References Cited

U.S. PATENT DOCUMENTS

| | | | |
|---|---|---|---|
| 2,246,610 | 6/1941 | Wagner . | |
| 2,472,752 | 6/1949 | Mackereth . | |
| 2,531,334 | 11/1950 | Grenat . | |
| 2,834,469 | 5/1958 | Mitterer . | |
| 2,872,872 | 2/1959 | Quintilian . | |
| 2,948,229 | 7/1960 | Brundage . | |
| 3,000,321 | 9/1961 | Parker . | |
| 3,096,720 | 7/1963 | Younger . | |
| 3,115,373 | 12/1963 | Alexander . | |
| 3,392,676 | 7/1968 | Bizier . | |
| 3,411,450 | 11/1968 | Clifton | 417/360 |
| 3,443,519 | 5/1969 | White . | |
| 3,482,125 | 12/1969 | Fleckenstein . | |
| 3,545,897 | 12/1970 | Russell | 417/360 |
| 3,802,804 | 4/1974 | Zimmermann | 417/360 |
| 4,123,201 | 10/1978 | Andriulis | 417/360 |
| 4,193,746 | 3/1980 | Aman, Jr. . | |
| 4,195,971 | 4/1980 | Graham . | |
| 4,211,519 | 7/1980 | Hogan | 417/360 |
| 4,439,096 | 3/1984 | Rockwood | 417/361 |
| 4,462,030 | 2/1987 | Friebe | 417/766 |
| 4,470,187 | 9/1984 | Klievoneit et al. . | |
| 4,500,270 | 2/1985 | Tuckey . | |
| 4,540,354 | 9/1985 | Tuckey . | |
| 4,596,519 | 6/1986 | Tuckey . | |
| 4,600,367 | 7/1986 | Teraughi | 417/364 |
| 4,601,378 | 7/1986 | Pierce et al. . | |
| 4,619,588 | 10/1986 | Moore . | |
| 4,626,178 | 12/1986 | Terumoto . | |
| 4,642,030 | 2/1987 | Friebe et al. . | |
| 4,716,931 | 1/1988 | Shibamoto . | |
| 4,778,349 | 10/1988 | Browning | 417/359 |
| 4,824,334 | 4/1989 | Ramsey | 417/360 |

FOREIGN PATENT DOCUMENTS

| | | | |
|---|---|---|---|
| 2724412 | 11/1978 | Fed. Rep. of Germany | 123/509 |

*Primary Examiner*—Carl Stuart Miller

*Attorney, Agent, or Firm*—Roylance, Abrams, Berdo & Goodman

[57] ABSTRACT

An add-on electric fuel pump having numerous advantageous features including an improved manner of replacing the seal at the shaft on the electric motor side of the pump, a versatile mounting bracket, and a fuel reservoir member having a plurality of chambers which permit internal bypassing of the fuel, thus avoiding a return line to the fuel tank. The fuel reservoir member is formed with a set of fuel chambers which cooperate with the pump to permit internal turbulent bypassing of the fuel, thus improving cooling and avoiding vapor lock.

34 Claims, 3 Drawing Sheets

FIG. 4
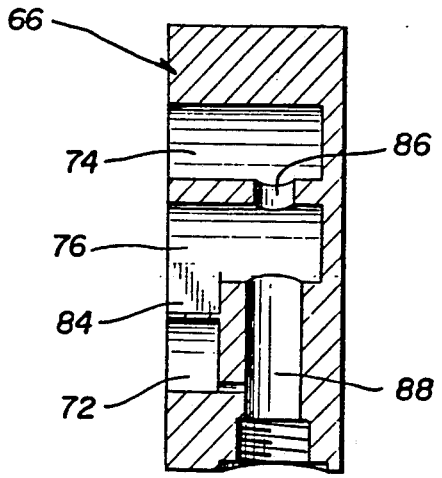
FIG. 5
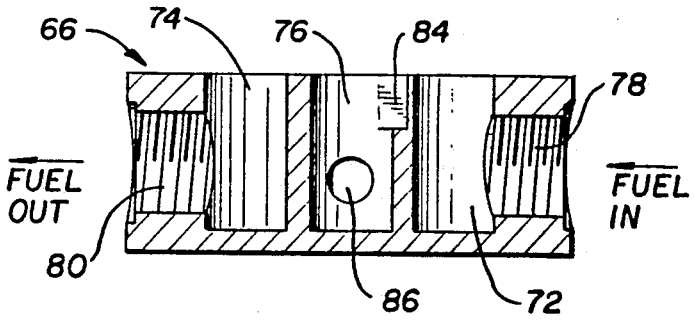
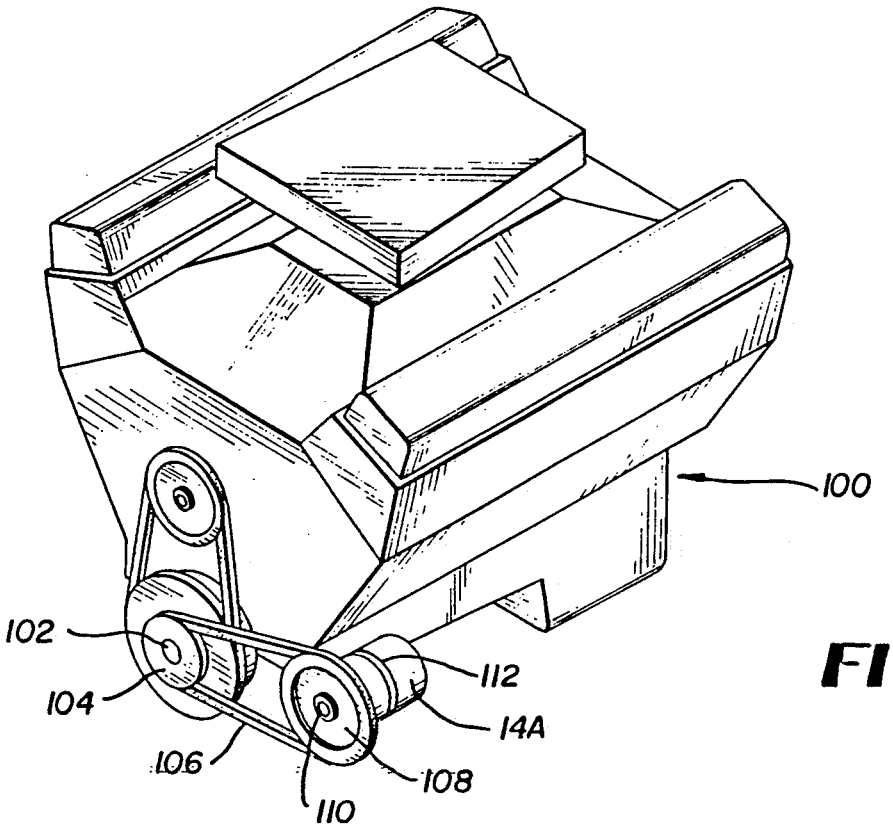
FIG. 6

FUEL PUMP

FIELD OF THE INVENTION

This invention relates to fuel pumps and in particular it relates to fuel pumps for use in automobiles, trucks and other automotive applications. Still more in particular, this invention pertains to an improved aftermarket or add-on fuel pump which may be electrically or mechanically driven, as by a belt.

BACKGROUND OF THE INVENTION

The present invention, in its preferred form, is a self-contained combined electric motor and pump in a single unit. It has bracket means to facilitate its mounting on an automobile or other vehicle with which it is most commonly used. The invention motor-pump unit is driven by electrical power taken from the vehicle in the conventional manner. That is, the pump of the invention allows itself to be readily mounted on a vehicle using ordinary tools, and is connected to the vehicle's electrical system to draw power in the ordinary manner of any other vehicle add-on device.

In automotive usage, it is common to have the original equipment electric fuel pump located inside the fuel tank. It is also common, for add-on devices, to have the fuel pump externally mounted because of the difficulties, dangers and expense of opening fuel tanks. The present invention is in this category of externally mounted add-on or substitute or high performance fuel pumps.

Many such prior art fuel pumps use vanes, i.e., they are of the common vane pump variety. The present invention pump is of the parachoid rotor (also called "gerotor") type. Parachoid rotor pumps including the invention pump have inherent advantages over vane pumps including light weight, quiet operation, high efficiency which results in a reduced amperage draw, and extremely long life, as much as three or four times the useful life of a comparable vane pump. Thus, the present invention, in common with parachoid rotor pumps in general, shares all of these advantages, and in addition has other advantages of its own.

The state of the art is to provide parachoid rotor electric fuel pumps for automobiles as original equipment in the gas tank itself exposed to the substantial quantity of liquid fuel in the gas tank. That liquid fuel serves as a heat sink for the pump and thus keeps it cool. Keeping a gasoline pump cool is important because if the temperature of the fuel rises above the fuel's boiling point, then the entire system will vapor lock which will cause the engine to stall for lack of fuel. This temperature is approximately 145° F. and it varies depending on the season of the year, the altitude, the fuel, and possibly other factors well known to those skilled in these arts.

Many prior art fuel pumps include external cooling fins. The present invention has no need for any such cooling fins. External cooling fins are undesirable because they add cost and complication to the manufacturing process and they are susceptable to breakage and the collection of debris in use thus frustrating or even totally defeating their intended purpose of cooling.

SUMMARY AND ADVANTAGES OF THE INVENTION

This invention is aimed at the aftermarket, that is, fuel pumps to replace original equipment fuel pumps that have failed, and it is also aimed at marine, racing and high performance applications where fuel demand is high. In order to meet performance needs, the pump must flow a large volume of fuel and must also avoid vapor lock conditions. Prior to this invention, this has not been possible for externally mounted, high volume parachoid rotor pumps unless a fuel return line was used. That is, the fuel pump must, in order to meet the needs of the engine, have the capability of pumping more fuel then the engine could possibly use. In the prior art, this required return of the excess fuel supplied by the pump but not needed by the engine. The conventional way of doing this has been with a return line. This is not convenient for aftermarket purposes because it requires entry into the fuel tank for a line to "dump" the returned fuel back into the fuel tank.

Overall, the present invention solves this problem with specially designed fuel chambers which operate together with a spring loaded bypass plunger located between two of the fuel chambers in the fuel reservoir member.

More in particular, the invention fuel reservoir member cooperates with a port plate. The fuel reservoir includes an inlet chamber and an outlet chamber. The parachoid rotor draws fuel from the fuel tank in through the inlet chamber, and then forces the fuel through itself and into the outlet chamber. After the outlet chamber, the fuel goes to the engine. The fuel reservoir member includes a third chamber (hereinafter called "the chimney") which interconnects the inlet and outlet chambers. However, when necessary, the fuel is bypassed back to the inlet chamber via the chimney. When the fuel demand of the engine, as when it is idling, is relatively low, a large percentage of fuel is so bypassed. The bypassed fuel is recirculated inside the pump's fuel chambers. In high volume pumps this generates heat. If this heat is not dissapated the temperature inside the pump will increase to the fuel's boiling point which will vapor lock the pump.

The shape of the centrally located "chimney", creates high turbulence in the liquid fuel as it passes back into the inlet chamber. This turbulence causes the fluid contacting the walls of the fuel reservoir member to be constantly exchanged, thus causing enough heat dissapation to prevent vapor lock.

The preferred embodiment of the invention comprises a single self-contained unit of an electric motor and the invention pump. However, the invention pump can be set up as a separate fuel pump. For automotive use, in such case, it will fitted with a pulley or other conventional means to direct mechanical drive, as by a belt to the crankshaft or to the some other power source on the engine.

Another advantageous feature of the invention, particularly for use in aftermarket applications, is its mounting bracket. This bracket is located between the underside of the electric motor housing and the top side of the pump housing. The bracket is fitted with a vibration damper. In use, many different orientations and angles at which the fuel lines of the vehicle approach the pump can be accommodated. The user simply loosens the two main tie screws and then the entire pump and motor housing can be turned on the vibration damper. And this can be done after the vertical part of the bracket is fixed to the vehicle. This adds great flexibility and facilitates use in aftermarket applications, thus yielding important advantages for the invention over the prior art.

Another aspect of this invention has to do with an improvement for replacement of the seal on the pump shaft. The invention pump includes an impregnated molybdenum bushing mounted inboard of the seal. A brass button is mounted on the port plate to limit axial motion of the shaft. An important advantage of this part of the invention is that is permits replacement of the seal without significant disassembly of the pump. In order to replace this seal in the invention pump, the main tie screws are removed thus freeing the motor from the pump. The seal can then be easily replaced. The bushing is of impregnated molybdenum or the like because it is exposed to the fuel being pumped.

The invention also includes a spring loaded piston which controls fuel flow communication between two of the chambers in the fuel reservoir member. It is important that this piston not "chatter" in use. The configurations and sizes of the inlet and bypass chambers in the fuel reservoir member are designed so that a slight back pressure is created on the piston in normal use. This back pressure causes the piston to operate only in response to changes in pressure in the outlet chamber which causes steady, smooth piston motion and avoids piston chatter. In effect, there is a slight pressure preload on the piston so that it responds more precisely to changes in fuel pressure only.

The above and other features and advantages of the invention will present themselves to those skilled in the art from a reading of the following detailed specification, reference being had to the accompanying drawing also forming part of this disclosure in which:

BRIEF DESCRIPTION OF THE DRAWING

FIGS. 4 and 5 are intersecting right angle cross-sectional views of the fuel reservoir member taken on lines 4—4 and 5—5 of FIG. 3 respectively; and FIG. 6 is a perspective view of a mechanical drive second embodiment of the invention.

DETAILED DESCRIPTION OF THE PREFERRED EMBODIMENTS

Figure 1:
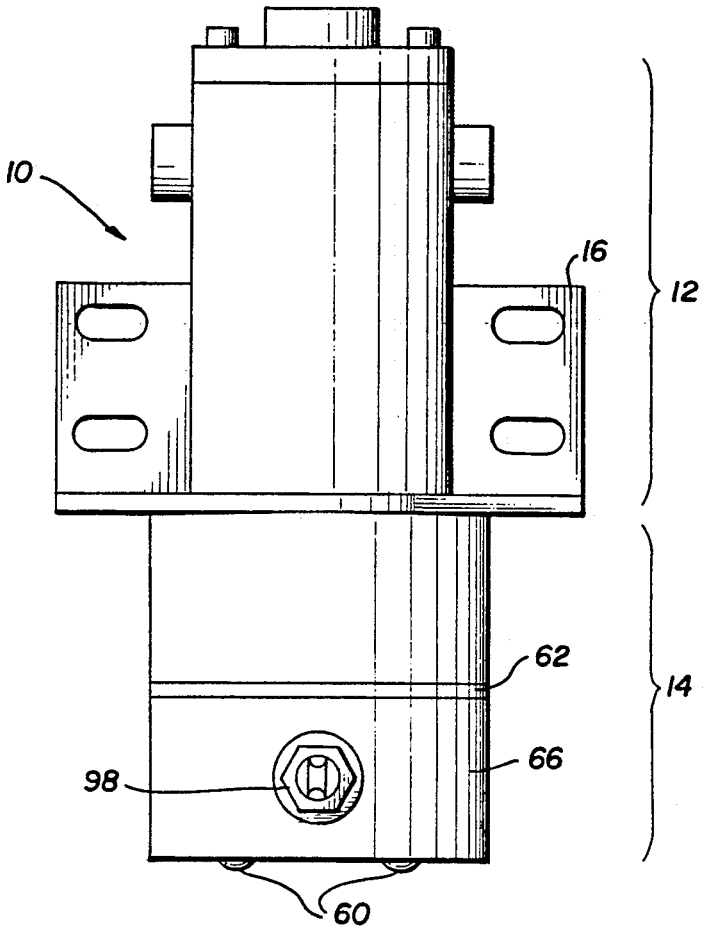
FIG. 1 is a front elevational view of a fuel pump according to the preferred embodiment the invention.

Referring now in detail to the drawings, in FIG. 1 there is shown the preferred embodiment of the invention self-contained electric fuel pump in vertical elevation as it would normally be mounted on a vehicle. Electric fuel pump 10 comprises a motor assembly 12, a pump assembly 14, and a bracket assembly 16 interconnecting the assemblies 12 and 14. Bracket 16 is formed with conventional openings as shown for adjustable mounting of electric fuel pump 10 to the chassis or other convenient portion of the vehicle to which pump 10 is to be mounted.

The fuel pump assembly 14 including its parts shown in FIGS. 3-5 and described below is used with motor assembly 12 in the FIG. 1 preferred form of the invention, but is also usable alone in other applications including the mechanical drive automotive use shown in FIG. 6.

Figure 2:
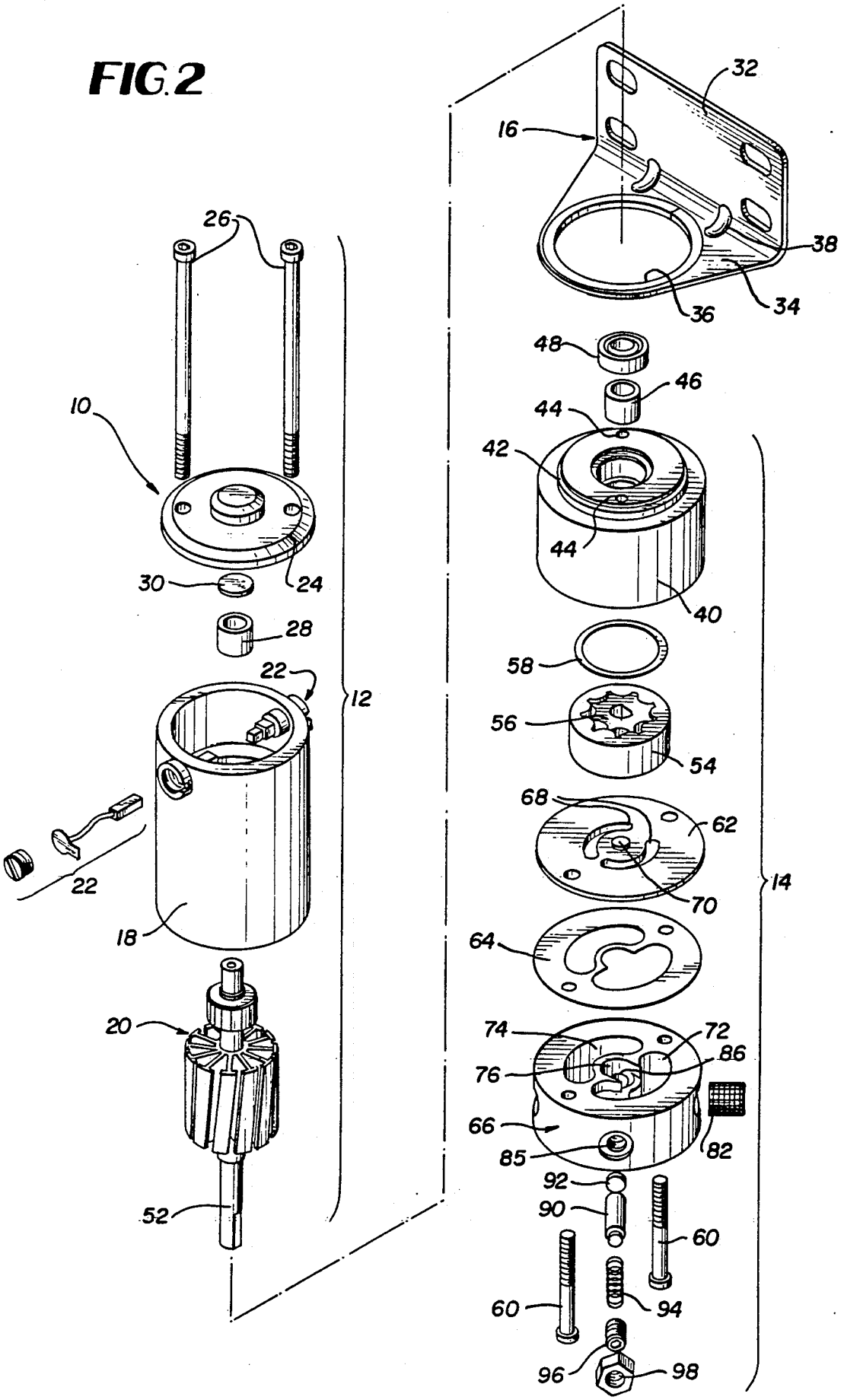
FIG. 2 is an exploded perspective view of the invention fuel pump of FIG. 1.

Referring now to FIG. 2, pump 10 is shown in exploded detail view. The electric motor assembly 12 is, in general, conventional and within the state of the art. It comprises a motor housing 18 which contains an armature 20 which cooperates with brush assemblies 22 fixed to the housing 18 in a conventional manner. The upper end of the housing 18, the other end being mounted on the bracket 16 as will be described below, is closed off by an end cap 24, and the motor assembly is held together by a pair of main tie screws 26. A bushing 28 and an end pad 30 are provided at the motor housing outer end of the armature shaft 20 and these two parts 28 and 30 cooperate with suitable holding means formed in the end plate 24.

The invention bracket member 16 comprises a leg or flange portion 32 which is normally vertically mounted in use. Leg or flange portion 32 is formed with a plurality of elongated openings to provide means to adjustably mount the bracket and the entire pump assembly 10 to a vehicle in a more or less conventional manner.

The bracket 16 further comprises a second leg or flange portion 34 which is normally horizontal in use. A pair of ribs 38, which may be pressed out of the metal, interconnect and strengthen the two flanges 32 and 34. Horizontal flange 34 is formed with an enlarged central opening in which is snuggly fitted a vibration damper 36. Damper 36 may be made of rubber or other resilent material. The diameter of the motor housing 18 is such as to fit snuggly on top of but not inside of the vibration damper 36.

The pump assembly 14 includes a main housing 40 having an upper stepped portion 42 which fits inside of the vibration damper 36. The pump housing 40 is formed with a pair of threaded openings 44 which cooperate with the main tie screws 26.

Thus, it can be seen that flange 34 and damper 36 are held sandwiched between the pump and motor portions 14 and 12 of the fuel pump 10 of FIG. 1.

This assemblage as thus far described provides substantial versatility and advantages for the invention as compared to the prior art. These advantages reside in flexibility and versatility in mounting. The invention fuel pump 10 can be rotated about its own axis on the bracket 16 after the bracket is fixed into position on the vehicle by simply loosening the two screws 26, whereupon the tight fit between the lower end of the motor housing 18 and the stepped portion 42 on the vibration damper 36 is relaxed, and the entire pump 10, both portions 12 and 14, can be rotated with respect to the fixed bracket 16 on vibration damper 36. This permits adjustment of the orientation of the pump 10 to accommodate the approach of wires to the motor portion 12 and fuel lines to the pump portion 14.

Continuing the description of pump 14, the upper end of the pump housing 40 is provided with suitably formed openings to receive a bushing 46 and a seal 48 mounted outboard of the bushing 46. Preferably, bearings 46 and 28 are sleeve bearings, and the seal 48 is press fit into the housing 40.

On the opposite side of the housing 40 from the seal 48 and bushing 46 there is provided the actual pump members 54/56, called a "gerotor" and more accurately a parachoid rotor pump. The outer gear 54 cooperates with the inner gear 56 thereof in a known manner, and an "O"-ring seal 58 is provided around the outer gear 54 between the port plate 62 and the underside of the housing 40. The electric motor armature shaft 52 extends through the bracket 16, through the seal 48 and bushing 46, and fits into the inner gear 56. It is held in fixed driving relation thereto by means of the small mating flats formed on the end of the shaft and in the center opening in the inner gear 56, as shown.

This arrangement of the parts as described in the preceding two paragraphs provides an important advantage for the invention over the prior art. More specifically, it provides for a much improved manner of replacement of the seal 48. The seal can be replaced as needed by releasing the main tie screws 26. This "drops" the entire pump assembly 14 out from its opening in the vibration damper 36. The important point however is that the pump itself remains assembled since there is no need to release the pump's own main tie screws 60 which fit in suitable openings through the other parts as shown and mate into threaded openings (not shown) in the underside of the housing 40. Thus, when the screws 26 are released and the pump drops away, the user can remove the failed seal 48 and replace it, no other modification or attention to any other part of the pump being necessary. The bushing 46 is made of a suitable material resistive to the fuel being pumped, such as impregnated molybdenum, in order to function properly as a bearing for the shaft 52 while at the same time not suffering any deterioration from its exposure to the fuel. This is an arrangement not heretofor known in the prior art and provides significant advantages for the invention, primarily as to the ease of maintenance of the seal 48.

Pump assembly 14 further includes a port plate 62, a gasket 64, and the main fuel reservoir member 66. These three parts are formed with through openings as shown to pass the pump's main tie screws 60 as described above. The port plate 62 is formed with a pair of arcuate openings 68 designed to cooperate with the parachoid rotor pump 54/56 in a conventional manner. A wear button 70 is provided in the center of the plate 62 to limit end play of the armature shaft 52.

The gasket 64 is formed with a pair of openings of a configuration to match the chambers in the fuel reservoir member 66, as is clear from FIG. 2.

Figure 3:
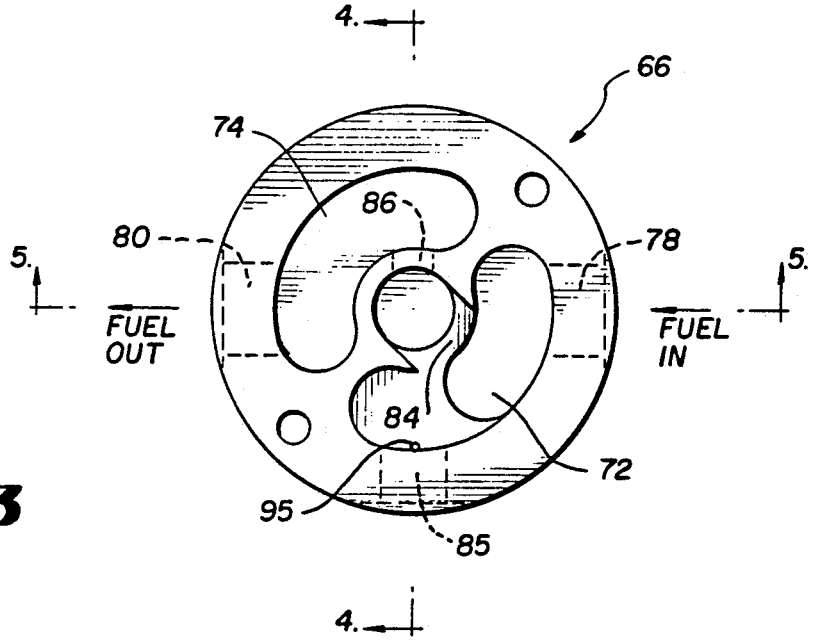
FIG. 3 is a top plan view of the fuel reservoir member.

The fuel reservoir member 66 is an important feature of the invention, and it is shown in more detail in FIGS. 3, 4, and 5. This description will be best understood by simultaneously viewing all of FIGS. 2–5 as to fuel reservoir member 66. Fuel reservoir member 66 is formed with three main chambers, the inlet chamber 72 into which fuel is sucked by the parachoid rotor pump 54/56; an outlet chamber 74 from which the fuel is supplied to the engine; and a bypass or "chimney" chamber 76 interconnecting the inlet and outlet chambers 72 and 74. Fuel is supplied from the tank by a conduit not shown which connects to supply means in the form of an opening 78 in communication with the inlet chamber 72. In a similar manner, fuel is pumped out of pump 14 by a conduit not shown which is connected to fuel delivery means in the form of an opening 80 which communicates with the outlet chamber 74. As shown in FIG. 2, a filter and flame arrestor device 82 is provided in the opening 78, in the more or less conventional manner modified as needed for use with the invention.

The means which permits the bypassing of fuel in a manner described below comprises a space or opening of generally rectilinear configuration 84 which communicates between the inlet chamber 72 and the bypass or chimney chamber 76. These bypass means also comprise another relatively small drilled hole 86 which communicates the bypass chamber 76 with the outlet chamber 74. Fuel reservoir member 66 is also formed with an opening 88 aligned with the opening 86. The bypass plunger assembly, best shown in FIG. 2, is fitted into this opening 88.

Passageway 88 is located in a position radial of the fuel reservoir member 66, and thus the bypass plunger 90 described below will operate along an axis positioned on a radial line with respect to the fuel reservoir member 66.

The bypass plunger 90 together with a sealing pad 92 and under the influence of a spring 94 bears against the opening 86 (see FIG. 4), to thus normally hold the communication between the chambers 74 and 76 in a closed condition. The bypass plunger assembly is completed by a threaded plug 96 which provides an adjustable preload on the spring 94 to allow by-pass pressure to be adjusted by the user. The opening 95, FIG. 3, communicates between the inlet chamber 72, FIG. 2, and the bypass plunger 90 within the opening 85 near the spring 94 to allow a preload on the bypass plunger 90 from pressure within the inlet chamber 72. In this manner, by having the plunger 90 exposed to the inlet and outlet pressures on its opposite sides, the plunger responds well to changes in the outlet pressure smoothly and substantially without chatter. The bypass plug 96 is held in position by means of a jam nut 98.

In operation, the parachoid rotor pump 54/56 sucks fuel in through the fuel supply 78 into the inlet chamber 72 and up into itself through the gasket 84 and the right hand arcuate opening 68 of port plate 62. The parachoid rotor pump 54/56 then pumps the fuel out through the companion opening 68 of the port plate 62 and down into outlet chamber 74 from which it is supplied to the engine via the fuel supply opening 80. That is the normal full fuel flow supply manner of operation of the invention. However, for reasons discussed above and as is well known to those skilled in the art, it is often necessary to bypass at least some and sometimes a substantial portion of the fuel pumped out by the parachoid rotor pump 54/56 back to some other place, usually back to the fuel tank by a return line. However, in the present invention it is bypassed by increased pressure on the plunger 90, which opens the opening 86, and allows the fuel to flow from the normal outlet supply chamber back through the opening 86, around the plunger 90, and back to the fuel supply chamber 72, thus rotating harmlessly around on that path including the parachoid rotor pump 54/56. When that occurs, less fuel is drawn from the tank through the opening 78.

Thus, it can be seen that the invention pump provides two substantially separate and independent fuel flow paths. One is through inlet 78, chamber 72, parachoid rotor pump 54/56, chamber 74, and out delivery 80. The second is turbulent bypass flow from chamber 74, through opening 86, around plunger 90, chimney 76, bypass space 84, chamber 72, parachoid rotor pump 54/56, and back to 74. Also, combinations of flow often occur when only part of the pump output is bypassed and part is delivered through delivery means 80.

As is known to those skilled in the art, bypassing a relatively large volume of fuel through the fuel pump itself in this manner runs a severe danger of vapor lock. This problem has been overcome in the prior art only by providing a fuel return line. The present invention prevents vapor lock by creating turbulence within the chambers 72, 74 and 76, and by providing that the turbulent flow of the fuel is exposed to a substantial amount of the surface of the inside walls of the fuel reservoir member 66 to thus enhance the cooling. The particular arrangement and configurations of the chambers 72, 74 and 76 accomplish this goal and the highly improved manner of operation of the invention. If the heat generated by the recirculating bypassed fuel is not dissipated, then the fuel will be raised in temperature to its boiling point, which will cause it to vaporize, which would cause vapor lock within the pump and a consequential stalling of the engine for lack of fuel. The "chimney" and how it is positioned with respect to the bypass flow path is deemed an important feature of the invention in accomplishing this manner of operation, that is, as to both the turbulence as well as the heat dissipation. This operates in this advantageous manner at both low engine speed, as at idle, at which time a great deal of the fuel is circulated within the three chambers of the pump. At high demand of the engine, or in the case of a high performance pump, as might be used for racing, the amount of fuel bypassed is low or perhaps even non-existing, and the advantageous manner of operation obtains at that time as well.

In the development of the invention, in earlier versions, a problem was encountered wherein the plunger 90 was found to "chatter", i.e., operate with rapid motions which were highly undesirable, destructive of parts and lubrication, and the like. This was solved by another advantageous feature of the invention. In particular, two cross-sectional areas in the bypass fuel path were selected to be of certain sizes and shapes and to be in a particular relationship to each other. Specifically, the cross-sectional area of the chimney or bypass chamber 76 as shown in FIG. 3 was made to be slightly larger than the cross-sectional area of the space 84. The cross-sectional area of the space 84 can be seen by viewing FIGS. 3 and 5 wherein its horizontal and vertical extents, respectively, can be observed. In this manner, the plunger 90 was caused to be subjected to a slight back pressure in the chimney 76. This back pressure acts as in effect, a preload. Thus, because it is preloaded in this manner by both the balance of forces caused by the spring 94 as well as the fuel itself flowing past the plunger 90, the plunger 90 responds to changes in pressure as are caused by changes in fuel demand only, and thus the "chatter" problem was entirely avoided and is not present in the present invention as shown in the drawings.

FIG. 6 shows a second embodiment of the invention pump arranged as a mechanically driven fuel pump 14A for an engine 100. Engine 100 has the usual crankshaft 102 that carries a plurality of pulleys including a fuel pump power pulley 104. A drive belt 106 is trained between pulley 104 and a pulley 108 fixed to a shaft 110 which drives pump 14A. The fuel lines to pump 14A have been omitted for clarity of the drawing. Any suitable means such as a bracket 112 is provided to mount pump 14A on engine 100. Other mechanical drive means could also be used, such as gears, toothed belts and the like.

In this embodiment, the electric motor 12 is not needed at all. Pump 14 shown in FIGS. 2–5 will be modified as needed to convert pump portion 14 to pump 14A. This conversion is well within the expertise of those skilled in these arts. The conversion will primarily comprise providing an end cap analogous to cap 24 at the upper end (as shown in FIG. 2) of housing 40, providing shaft 110 (analogous to armature shaft 52), and sealing this shaft 110 where it passes through the new end cap.

This mechanically driven fuel or other kind of pump 14A may be needed in some particular environment, automotive or other. All of the advantages of the invention are as fully available in such cases as in the preferred electric motor drive fuel pump embodiment of FIG. 1.

While the invention has been described in some detail above, it is understood that this detailed description is by way of example only, and the protection granted is to be limited only within the spirit of the invention and the scope of the following claims.

What is claimed:

1. In a fuel pump, the combination comprising a fuel reservoir member, said fuel reservoir member being formed with a plurality of fuel chambers, said chambers comprising an inlet chamber and an outlet chamber, means to supply fuel to said inlet chamber, means to deliver fuel from said outlet chamber to a point of use, said fuel reservoir member chambers also including a bypass chamber, means interconnecting said bypass chamber with said outlet chamber; said fuel pump also comprising pump means interconnecting said inlet chamber and said outlet chamber and adapted to suck fuel from said fuel supply means into said inlet chamber, through said pump means, out said outlet chamber, and to said fuel delivery means; said bypass chamber and said pump means providing two substantially separate paths of fuel flow in said fuel reservoir member, bypass plunger means normally closing off the flow of fuel through said bypass chamber, one of said substantially separate paths including said fuel supply means and said fuel delivery means when said bypass plunger means is closed, the second of said substantially separate paths including said bypass chamber when said bypass plunger means is open, and all of said chambers and said interconnecting means therebetween being configured so as to create turbulence in the flow of any fuel supplied to said outlet chamber by said pump means and bypassed through said bypass chamber and said interconnecting means, whereby all of the fuel passing through said fuel pump remains below its vaporization temperature to thereby prevent vapor lock of said fuel pump, said fuel pump comprising an electric motor portion and a pump portion, said electric motor portion comprising a drive shaft extending into said pump portion, said fuel pump also comprising a mounting bracket, said mounting bracket comprising a flange portion formed with a round opening, vibration damper means in said flange portion round opening, means to sandwich said flange between said electric motor and said pump portions of said fuel pump with said electric motor and pump portions on opposite sides of said vibration damper means, and one of said electric motor and pump portions having a portion thereof extending into said flange round opening, whereby said fuel pump can be rotated within said opening around the axis thereof for adjustment of said fuel pump with respect to said mounting bracket.

2. In a fuel pump, the combination comprising a fuel reservoir member, said fuel reservoir member being formed with a plurality of fuel chambers, said chambers comprising an inlet chamber and an outlet chamber, means to supply fuel to said inlet chamber, means to deliver fuel from said outlet chamber to a point of use, said fuel reservoir member chambers also including a bypass chamber, said inlet, outlet and bypass chambers being located in said fuel reservoir member in a closely spaced and co-planar relation to each other, said fuel reservoir member being formed with relatively thin wall portions which are common walls between said inlet, outlet and bypass chambers, means interconnecting said bypass chamber with said outlet chamber; said fuel pump also comprising pump means interconnecting said inlet chamber and said outlet chamber and adapted to suck fuel from said fuel supply means into said inlet chamber, through said pump means, out said outlet chamber, and to said fuel delivery means; said bypass chamber and said pump means providing two substantially separate paths of fuel flow in said fuel reservoir member, bypass plunger means normally closing off the flow of fuel through said bypass chamber, one of said substantially separate paths including said fuel supply means and said fuel delivery means when said bypass plunger means is closed, the second of said substantially separate paths including said bypass chamber when said bypass plunger means is open, and all of said chambers and said interconnecting means therebetween being configured so as to create turbulence in the flow of any fuel supplied to said outlet chamber by said pump means and bypassed through said bypass chamber and said interconnecting means.

3. The combination of claim 2, said fuel reservoir member being of a generally cylindrical configuration, said bypass plunger means being positioned generally radially of said fuel reservoir member, spring means normally biasing said bypass plunger to close said interconnecting means between said bypass chamber and said outlet chamber, interconnecting means between said bypass chamber and said inlet chamber, and the cross-sectional area of said interconnecting means between said bypass chamber and said inlet chamber with respect to the cross-sectional area of said bypass chamber being such as to provide a preload type of force on said bypass plunger, whereby said bypass plunger is prevented from "chattering" in use.

4. The combination of claim 2, interconnecting means between said bypass chamber and said inlet chamber, and said interconnecting means being of different shapes and cross-sectional areas with respect to each other to thereby provide a preload on said bypass plunger.

5. The combination of claim 4, said interconnecting means between said bypass chamber and said outlet chamber being a hole of round cross-sectional shape and interconnecting means between said bypass chamber and said inlet chamber comprising an opening of generally rectilinear shape.

6. The combination of claim 2, said fuel reservoir member being of a generally cylinderical shape, said turbulence creating configurations of all of said chambers and of said interconnecting means including a generally cylinderical shape of said bypass chamber, said bypass chamber being generally centrally and axially positioned in said generally cylinderical fuel reservoir member, and said inlet chamber and said outlet chamber being of generally arcuate configuration and arranged around said bypass chamber.

7. The combination of claim 6, said interconnecting means between said bypass chamber and said outlet chamber being a hole of round cross-sectional shape and interconnecting means between said bypass chamber and said inlet chamber comprising an opening of generally rectilinear shape.

8. The combination of claim 6, said fuel delivery means and fuel supply means being arranged generally radially of said fuel reservoir member, and said bypass plunger being arranged for motion along a line positioned generally radially of said fuel reservoir member.

9. The combination of claim 2, said pump means including a parachoid rotor and mating housing pump.

10. The combination of claim 1, said means to sandwich comprising tie bolt means interconnecting said electric motor and pump portions, and said bolt means extending through said flange opening.

11. The combination of claim 2, said fuel pump comprising an electric motor portion and a pump portion, said electric motor portion comprising a drive shaft extending into said pump portion to drive said pump portion, said pump portion comprising a housing, means to join said electric motor portion to said pump portion housing, said pump portion comprising bearing means to support said drive shaft and its rotation in said pump housing, said pump portion comprising sealing means, and means to secure said sealing means in said pump housing between said bearing means and said electric motor portion, whereby said sealing means can be replaced by disassembly of said pump portion from said electric motor portion but without disassembly of said pump portion.

12. The combination of claim 11, said bearing means comprising an impregnated molybdenum sleeve bearing.

13. The combination of claim 2, and an automotive engine, mechanical drive means interconnecting said fuel pump and said engine, said mechanical drive means comprising a fuel pump drive shaft joined to said pump means and extending externally of said fuel pump, a fuel pump pulley mounted on said fuel pump drive shaft externally extending portion, a power pulley for said fuel pump on said engine, and a drive belt trained between said power pulley and said fuel pump pulley.

14. An automotive add-on electric fuel pump for use externally of the fuel tank, said fuel pump comprising an electric motor portion and a pump portion, said electric motor portion comprising a drive shaft extending into said pump portion, said fuel pump also comprising a mounting bracket, said mounting bracket comprising a flange portion formed with a round opening, vibration damper means in said flange portion round opening, means to sandwich said flange between said electric motor and pump portions of said fuel pump with said electric motor and pump portions on opposite sides of said vibration damper means, and one of said electric motor and pump portions having a portion thereof extending into said flange round opening, whereby said fuel pump can be rotated within said opening around the axis thereof for adjustment of said fuel pump with respect to said mounting bracket.

15. The fuel pump of claim 14, said means to sandwich comprising tie bolt means interconnecting said electric motor and pump portions, and said bolt means extending through said flange opening.

16. The combination of claim 14, pump means including a parachoid rotor and mating housing pump.

17. An automotive fuel pump comprising an electric motor portion and a pump portion, said electric motor portion comprising a drive shaft extending into said pump portion to drive said pump portion, said pump portion comprising a housing, means to join said electric motor portion to said pump portion housing, said pump portion comprising bearing means to support said drive shaft and its rotation in said pump housing, said pump portion comprising sealing means, means to secure said sealing means in said pump housing between said bearing means and said electric motor portion, whereby said sealing means can be replaced by disassembly of said pump portion from said electric motor portion but without substantial disassembly of said pump portion, and said bearing means comprising an impregnated molybdenum sleeve bearing.

18. The fuel pump of claim 17, said pump portion including a parachoid rotor and mating housing pump.

19. In a fuel pump, the combination comprising a fuel reservoir member, said fuel reservoir member being formed with a plurality of fuel chambers, said chambers comprising an inlet chamber and an outlet chamber, means to supply fuel to said inlet chamber, means to deliver fuel from said outlet chamber to a point of use, said fuel reservoir member chambers also including a bypass chamber, means interconnecting said bypass chamber with said outlet chamber; said fuel pump also comprising pump means interconnecting said inlet chamber and said outlet chamber and adapted to suck fuel from said fuel supply means into said inlet chamber, through said pump means, out said outlet chamber, and to said fuel delivery means; said bypass chamber and said pump means providing two substantially separate paths of fuel flow in said fuel reservoir member, bypass plunger means normally closing off the flow of fuel through said bypass chamber, one of said substantially separate paths including said fuel supply means and said fuel delivery means when said bypass plunger means is closed, the second of said substantially separate paths including said bypass chamber when said bypass plunger means is open, all of said chambers and said interconnecting means therebetween being configured so as to create turbulence in the flow of any fuel supplied to said outlet chamber by said pump means and bypassed through said bypass chamber and said interconnecting means said fuel pump comprising an electric motor portion and a pump portion, said electric motor portion comprising a drive shaft extending into said pump portion, said fuel pump also comprising a mounting bracket, said mounting bracket comprising a flange portion formed with a round opening, vibration damper means in said flange portion round opening, means to sandwich said flange between said electric motor and pump portions of said fuel pump with said electric motor and pump portions on opposite sides of said vibration damper means, one of said electric motor and pump portions having a portion thereof extending into said flange round opening, whereby said fuel pump can be rotated within said opening around the axis thereof for adjustment of said fuel pump with respect to said mounting bracket, said pump portion comprising a housing, means to join said electric motor portion to said pump portion housing, said pump portion comprising bearing means to support said drive shaft and its rotation in said pump housing, said pump portion comprising sealing means, and means to secure said sealing means in said pump housing, whereby said sealing means can be replaced by disassembly of said pump portion from said electric motor portion but without substantial disassembly of said pump portion.

20. The combination of claim 19, said interconnecting means being of different shapes and cross-sectional areas with respect to each other to thereby provide a preload on said bypass plunger.

21. The combination of claim 19, said fuel reservoir member being of a generally cylindrical shape, said turbulence creating configurations of all of said chambers and of said interconnecting means including a generally cylindrical shape of said bypass chamber, said bypass chamber being generally centrally and axially positioned in said generally cylindrical fuel reservoir member, said inlet chamber and said outlet chamber being of generally arcuate configuration and arranged around said bypass chamber, interconnecting means between said inlet chamber and said bypass chamber, and said interconnecting means each being of a different shape and cross-sectional area.

22. The combination of claim 19, said pump means including a parachoid rotor and mating housing pump.

23. The combination of claim 19, said means to sandwich comprising tie bolt means interconnecting said electric motor and pump portions, and said bolt means extending through said flange opening.

24. The combination of claim 19, said bearing means comprising an impregnated molybdenum sleeve bearing.

25. The fuel pump of claim 2, said fuel reservoir member including means interconnecting said bypass chamber with said inlet chamber.

26. The fuel pump of claim 2, also comprising means interconnecting said inlet chamber and said inlet chamber, whereby said interconnecting means causes said plunger means to respond to differences in the pressures in said inlet and outlet chambers.

27. The fuel pump of claim 19, said fuel reservoir member including means interconnecting said bypass chamber with said inlet chamber.

28. A fuel pump reservoir member formed with a plurality of fuel chambers comprising an inlet chamber, an outlet chamber and a bypass chamber, said inlet, outlet and bypass chambers being located in said fuel reservoir member in closely spaced and co-planar relation to each other, said fuel reservoir member being formed with relatively thin wall portions which are common walls between said inlet, outlet and bypass chambers, means to deliver fuel from a fuel source to said inlet chamber, means to deliver fuel from said outlet chamber to a point of use, means formed in said reservoir member interconnecting said bypass chamber with said outlet chamber, said inlet and outlet chambers being located opposite one another, and said bypass chamber being located between said inlet and outlet chambers.

29. A fuel pump reservoir member according to claim 28, also comprising means interconnecting said bypass chamber with said inlet chamber.

30. A fuel pump reservoir member according to claim 28, also comprising bypass plunger means normally closing off the flow of fuel from said outlet chamber to said bypass chamber.

31. A fuel pump reservoir member according to claim 30, also comprising means interconnecting said inlet chamber and said bypass chamber, whereby said interconnecting means causes said plunger means to respond to differences in the pressures in said inlet and outlet chambers.

32. A fuel pump reservoir member according to claim 28, said reservoir member being of a substantially cylindrical configuration, and said inlet chamber and said outlet chamber each having an arcuate configuration.

33. The combination of claim 2, and means interconnecting said inlet chamber and said bypass chamber, said last mentioned interconnecting means comprising a space formed by removal of a portion of said wall means, and said space having a cross-sectional area only slightly smaller than the cross-sectional area of said bypass chamber.

34. The combination of claim 29, said interconnecting means comprising a space formed by removal of a portion of said wall means, and said space having a cross-sectional area only slightly smaller than the cross-sectional area of said bypass chamber.

* * * * *

UNITED STATES PATENT AND TRADEMARK OFFICE

CERTIFICATE OF CORRECTION

PATENT NO. : 5,007,806

DATED : April 16, 1991

INVENTOR(S) : Peter Bellis and Frederick Nesselrode

It is certified that error appears in the above-identified patent and that said Letters Patent is hereby corrected as shown below:

Claim 26, column 12, line 18, "inlet" (second occurrence) should read --bypass--.

Signed and Sealed this

Twentieth Day of April, 1993

*Attest:*

MICHAEL K. KIRK

*Attesting Officer*

*Acting Commissioner of Patents and Trademarks*